US006419611B1

(12) United States Patent
Levine et al.

(10) Patent No.: US 6,419,611 B1
(45) **Date of Patent: *Jul. 16, 2002**

(54) EXERCISE DEVICE

(75) Inventors: James H. Levine; Douglas L. Sheadel, both of Westford; Peter A. Latham, Brookline, all of MA (US)

(73) Assignee: FitnessLab, LLC, WestFord, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/470,846

(22) Filed: Dec. 23, 1999

Related U.S. Application Data

(63) Continuation of application No. 09/119,854, filed on Jul. 21, 1998, now Pat. No. 6,045,489.

(60) Provisional application No. 60/076,801, filed on Mar. 4, 1998.

(51) Int. Cl.[7] ..... A63B 21/008; A63B 21/04; A63B 23/035

(52) U.S. Cl. ..... 482/53; 482/62; 482/112; 482/130

(58) Field of Search ..... 482/26, 27, 29, 482/62, 51–54, 74, 75, 77, 79, 111–113, 121, 130, 139; 472/134, 135

(56) References Cited

U.S. PATENT DOCUMENTS

| | | | | |
|---|---|---|---|---|
| 2,476,921 A | | 7/1949 | Shock | |
| 3,100,483 A | | 8/1963 | Altmeyer et al. | |
| 3,785,642 A | | 1/1974 | Sterlicchi | |
| 4,146,222 A | | 3/1979 | Hribar | |
| 4,204,675 A | * | 5/1980 | McGinnis | 272/130 |
| 4,836,530 A | | 6/1989 | Stanley, Jr. | |
| 5,236,407 A | | 8/1993 | Wang | |
| 5,256,118 A | | 10/1993 | Chen | |
| 5,267,923 A | | 12/1993 | Piaget et al. | |
| 5,304,105 A | | 4/1994 | Hsieh | |
| 5,346,444 A | | 9/1994 | Hsieh | |
| 5,374,225 A | | 12/1994 | Wilkinson | |
| 5,411,454 A | | 5/1995 | Chang | |
| 5,472,390 A | | 12/1995 | Faye | |
| 5,499,417 A | | 3/1996 | Wang | |
| 5,851,166 A | * | 12/1998 | Bernardson | 482/79 |
| 6,045,489 A | * | 4/2000 | Levine et al. | 482/53 |

FOREIGN PATENT DOCUMENTS

| | | |
|---|---|---|
| DE | 2261989 | 6/1974 |
| DE | 2926401 | 2/1980 |
| EP | 73744 | 3/1983 |
| FR | 2683727 | 6/1993 |
| GB | 2176412 | 12/1986 |
| SU | 1635991 | 3/1991 |
| SU | 1766434 | 10/1992 |

* cited by examiner

*Primary Examiner*—Jerome W. Donnelly
*Assistant Examiner*—Victor K. Hwang
(74) *Attorney, Agent, or Firm*—Perkins, Smith and Cohen, LLP; Jerry Cohen; Peter J. Borghetti

(57) ABSTRACT

An exercise device having two chambers, underlying two elastic membrane portions, in a position to closely support above the ground, the left and right foot respectively, of a user. A support structure such as a housing for the first and second membrane portions permit raising and lowering, as by shifting body weight, of the left and right foot in a stair stepping action, preferably without raising each foot from contact with the membrane portions to elastically stretch the membrane portions in succession. A fluid underlies the first and second elastic membrane portions. The fluid preferably is displaced by the stretching of each membrane portion and in the preferred embodiments, it acts with the membrane portions to support the body of a user in use.

4 Claims, 9 Drawing Sheets

EXERCISE DEVICE

RELATED APPLICATION

This application is a continuation application to U.S. Ser. No. 09/119,854, filed Jul. 21, 1998, and entitled EXERCISE DEVICE, now U.S. Pat. No. 6,045,489, which in turn is based on provisional application Ser. No. 60/076,801 filed Mar. 4, 1998, and entitled EXERCISE DEVICE all incorporated by reference herein.

BACKGROUND OF THE INVENTION

A large variety of stationary walking or stair stepping type exercise devices are known in the art. With conventional treadmill or stair stepping machines and exercise devices, a person who uses a device steps up and down often on pedals, platforms or belts that mechanically activate hydraulic, coiled, leaf, bellows type springs, rollers and the like for creating resistance to each downward step. These devices isolate specific motions that the limbs can make under resistance. The directed motion of most devices prevents the foot stepping down on the devices for making micro-adjustments that develop the ability to balance. Walking and running on most environmental surfaces may place the foot and leg tissues at risk of injury due to compression or impact. Once injured, the tissues are even more sensitive to compression and impact during additional vigorous aerobic activities. Further vigorous exercise is often postponed to allay risks of further injury. Stresses on tissues can be reduced by conducting exercises under water, where the water provides fluid resistance through a fall range of motion. However, water exercise devices can be inconvenient and/or expensive to operate and use.

SUMMARY OF THE INVENTION

It is an object of this invention to provide an exercise device for exercising the legs and lower body muscles of a person, with minimized risk of joint and soft tissue injury.

Still another object of this invention is to provide an exercise device in accordance with the preceding objects which also provides exercise to the upper body and hands of a user while allowing excellent aerobic exercise for stamina and cardiovascular improvements which may be possible even if existing weakness or injury prevents other activities such as walking or running.

Still another object of this invention is to provide an exercise device in accordance with one or more. of the previous objects, which device provides a fluid pressure enabled by a stair-stepping action of the body to act in conjunction with an elastic membrane so that a stepping down action causes a stepping up action in an alternate foot of a body and vice versa.

According to the invention an exercise device for supporting a left and right foot of the user and allowing alternate successive raising and lowering action of each foot for exercise of said user, has a first elastic membrane portion and a second elastic membrane portion in position to closely support the left and right foot of the user respectively, above the ground. A support structure for the first and second membrane portions allows raising and lowering movement of the right and left foot in a stair-stepping action to elastically stretch the membrane portions in succession and allow return to the original condition. A confined fluid underlies the first and second membrane portions which fluid is displaced by stretching of each membrane portion. Preferably the fluid is contained in chambers under the first and second elastic membrane portions and shifted from beneath one portion to the other and vice versa in successive raising and lowering of each foot of the user in a stair stepping action.

In the preferred embodiment, the fluid is air although it can be other gasses, water, other liquids or a gel.

In still another embodiment, the chambers under the first and second elastic membrane portions can be bladders and in some cases the membranes themselves can form a portion of the bladders. In the preferred embodiment, the fluid is transferred from one chamber or bladder to another underlying the membrane portions so that downward pressure of one foot will cause upward pressure on the other foot and vice versa as the body of the user acts in a stair stepping manner.

In still another embodiment, the exercise device of this invention includes a left and right hand gripping structure to provide for balance of the body when the feet are on the first and second membrane portions. In one embodiment, the left and right hand gripping structure has hand grips which move reciprocally from front to rear of the body allowing a sliding motion of the hands to provide upper body exercise over a wide range of motion as opposed to a stationary hand-gripping structure.

In a method of this invention, an individual's feet are positioned in contact with the surface of a first and second elastic membrane portion which first and second elastic membrane portions are supported above fluid chambers interconnected with each other. The exercise device is then actuated by the downward and reactive upward pressure on the feet of the user in a number of successive up and down leg motions while the user preferably holds a hand-gripping portion to provide exercise in accordance with the present invention.

It is a feature of this invention that the device can be used barefoot to maximize the gentle elastic pressure of the membrane portions or can be used with shoes. Preferably, the device is used barefoot or with foot surface conforming materials such as socks on the foot. The foot being cradled in the stretching membrane allows a wide range of motion. Correction for the fluid nature of the surface develops the ability to use small muscles in the foot to maintain balance. Hand grips can be mounted on rails to further support and balance the body. The flexible resistance of the fluid beneath the membrane supports the body as does water while swimming. The use of a stationary or moveable hand grips provide a wide range of upper body motion in use of the exercise device of this invention to vary the body exercise. The exercise devices of this invention can be low cost, pleasing to the eye and easily stored and moved in the home or elsewhere. The exercise devices can be used by children as well as adults providing family fun, exercise and fitness in what can be entry level or advanced exercise low cost devices.

BRIEF DESCRIPTION OF THE DRAWINGS

The above and other objects, advantages and features of the present invention will be better understood from the following specification when read in conjunction with the accompanying drawings where identical numbers indicate identical components and in which.

BRIEF DESCRIPTION OF THE INVENTION

Figure 3:
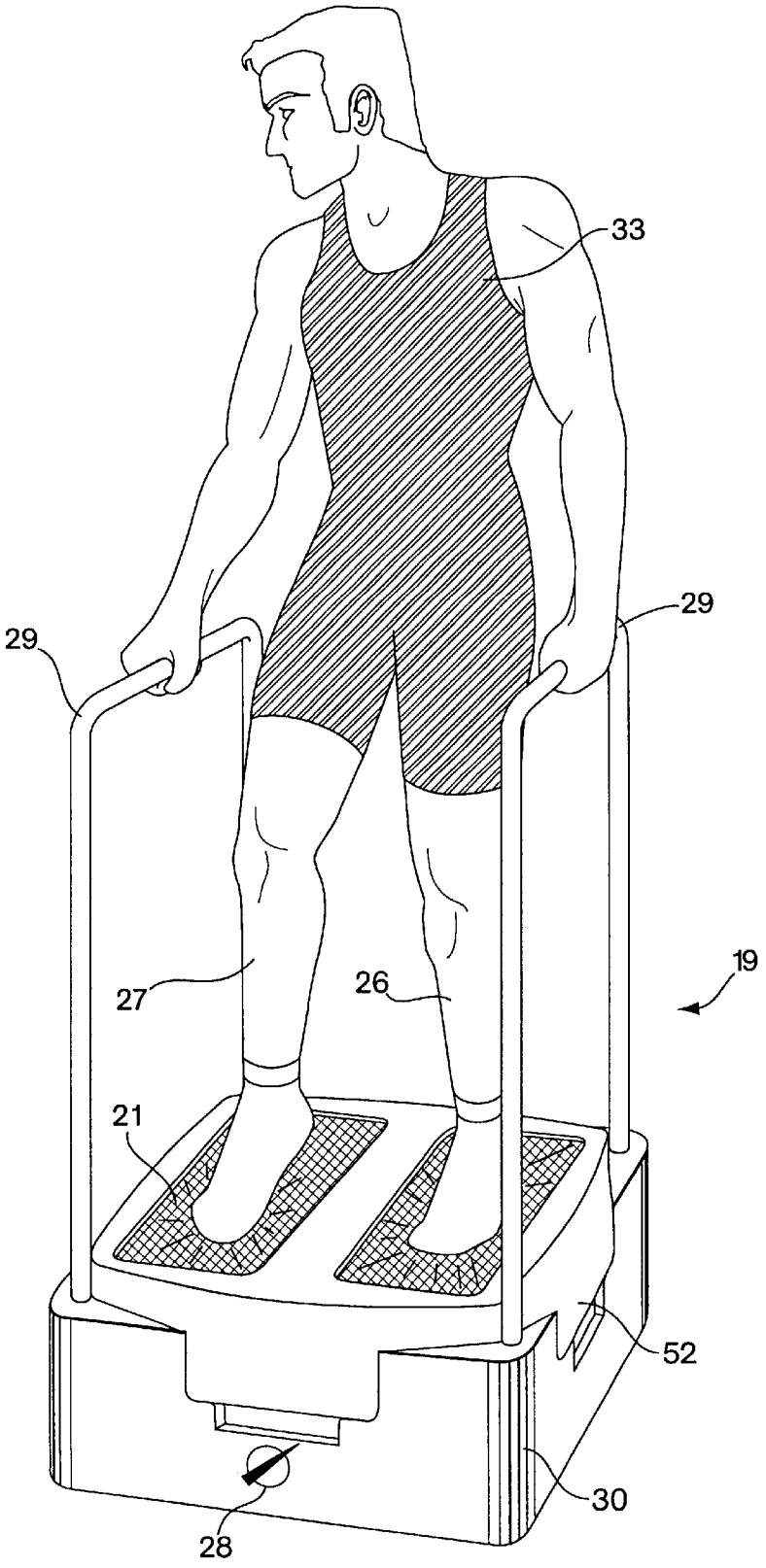
FIG. 3 shows a front perspective view of a preferred embodiment of the present invention utilizing resistance based on stretching elastic membrane portions and fluid displacement.
Figure 4:
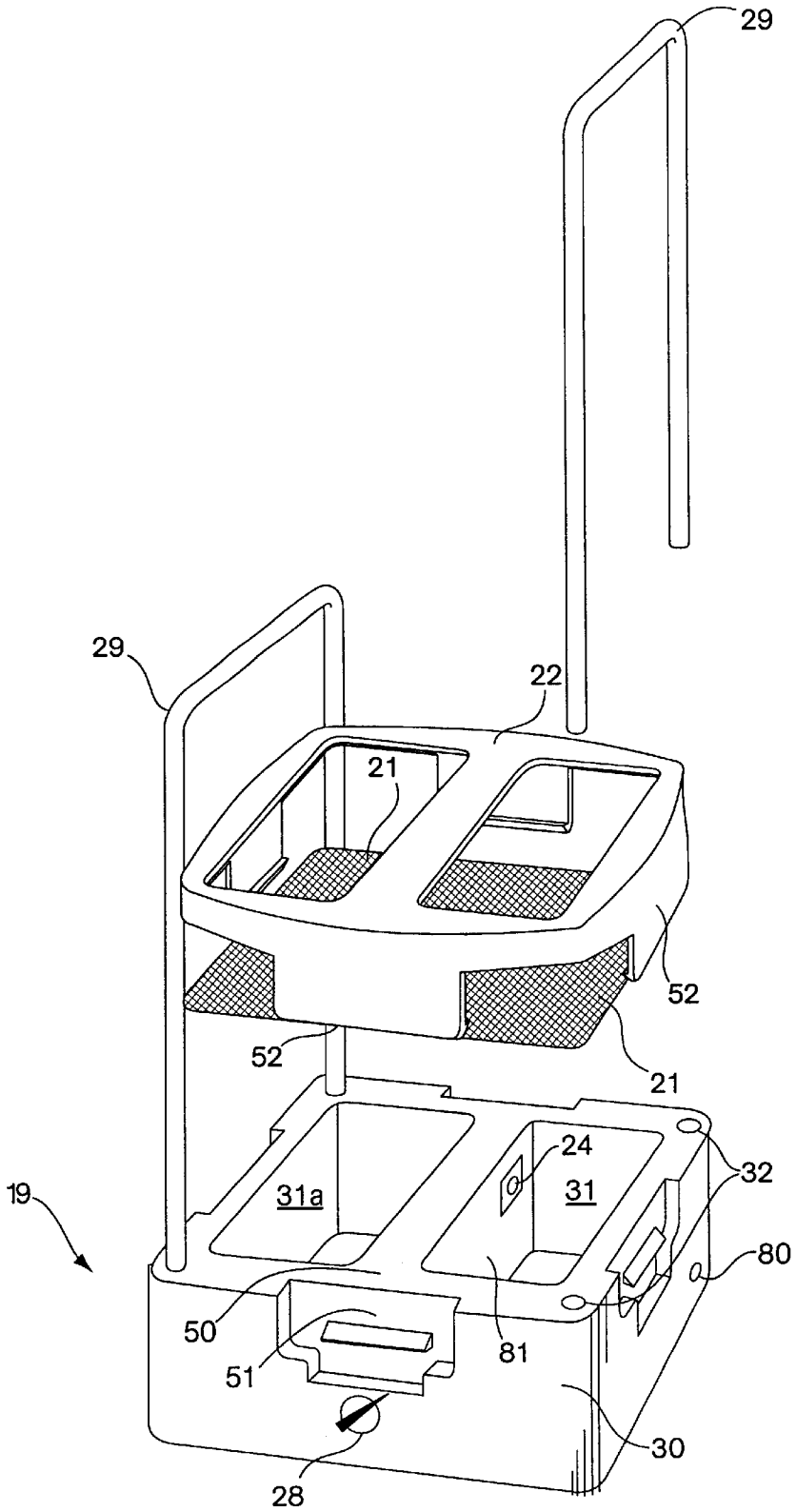
FIG. 4 is a partially exploded semi-diagrammatic front perspective view of the embodiment in accordance with FIG. 3.

With reference now to the drawings, and more particularly to FIGS. 3 and 4, a preferred embodiment 19 of an exercise device of this invention is shown. The exercise device 19 comprises a support structure in the form of a base 30, a frame 22 carrying a membrane 21 having right foot and left foot membrane portions which support the weight of a user. The user can be a person 33 diagrammatically shown in FIG. 3 exercising on the device 19.

Preferably, first and second hand grips 29 each in the form of generally U-shaped rails (which are identical) are mounted on the right and left side of the body as shown in FIG. 3.

The hand grips are fixed or removable in position in the base 30 as by being supported by bores in the base. Each hand grip has an upper substantially horizontal section of its U-shape to aid in balancing the body when the legs 26 and 27 of the user engage the feet with membrane 21 in a stair stepping-type exercise. In some embodiments the exercise device has no hand grips and the base and membrane act as the entire device.

A fluid is positioned in the base interconnected with chambers 31 and 31*a* provided in the base 30, which chambers are interconnected with each other through a passageway 24. The passageway 24 can be a pipe or integral tube passageway in the base and can vary in size to provide a predetermined resistance to flow of air or other fluid from chamber 31 to chamber 31*a*, and vice versa. In addition, passageway 24 can be provided with a valve as diagrammatically shown at 28 to vary the size of the passageway as may be desired to increase or decrease the resistance to flow for purposes as will be described. The valve can be a gate valve in passageway 24 with an actuating handle accessible at the outside of base 30 for adjustment by a user. A tube 80 passes from the outside of the base 30 to a chamber 31 to allow adjustment of air pressure in the chamber. The tube preferably has a sealed screw cap allowing sealing when closed and removal when desired to replenish any lost air in chambers 31, 31*a* or to add, remove, replace or adjust pressure when desired of any fluid in the chambers.

A key feature of the present invention is the use of elastic or flexible membrane 21. The membrane may comprise a single sheet elastic membrane or a plural piece or plural layer elastic membrane, but in either case is divided into right foot and left foot portions as best shown in FIG. 3. The flexible elastic membrane portions reduce the compression force on muscles and joints and increases balance of the user. Thus, the device allows a vigorous aerobic workout with substantially zero impact, low compression, and low risk of foot or joint injury.

Each membrane portion is large enough to accommodate a person's foot and support the feet of a user above any solid surface such as the ground. The membrane is preferably at least partially supported by fluid and thus the foot micro-adjusts to the flexing membrane surface developing the body's ability to maintain balance in all circumstances. When a user puts all his weight on one foot, that weight is supported primarily by the membrane in some embodiments. The elastic membrane 21 is preferably a single sheet but can be separate left and right foot portions.

The elastic membrane 21 is preferably a sheet of rubber or neoprene material, and in the preferred embodiments may be 0.06 inch in thickness and have a durometer of 40 on the Shore A scale. Membranes can vary in material, elasticity, thickness and durometer rating so long as they support the user's feet above any solid surface when used alone, or provide required support when used in conjunction with fluid pressure in an underlying chamber, as in the preferred embodiments.

Suitable membranes include elastic or resilient polymeric material such as natural rubber membranes and synthetic rubber membranes such as neoprene. Other elastic polymeric materials can be used. A particularly suitable membrane is formed of Style Number 28 natural rubber sheet available from the Biltrite Corporation of Waltham, Massachusetts. Such membranes can have thicknesses of 1/32 to 1/2 inch or more and a durometer reading of 40 Shore A,±5. Style 28 has a tensile strength of 3000 lbs. and an elongation of 600% at temperature of −20° F. to +140° F. Such rubber membranes have superior resilience, tensile, elongation and abrasion resistant properties with good tear strength and resistance to many chemicals. Similar membranes, such as neoprene and other elastic polymeric materials, are known and can be used in the various embodiments of the present invention. Planar, smooth surfaced sheets are preferred, although the foot engaging surface can be enhanced with non slip shapes such as knobs, ridges or the like.

The membrane portions for the left and right foot are preferably sufficient in width and length to accommodate the left and right foot of the user, and preferably each have a width of from 9 to 11 inches and a length of from 15 to 19 inches.

The base 30 can be made of any rigid material which will maintain the fluid chambers or compartments 31 and 31*a* substantially rigid and support the weight of the user in use without buckling or deforming. In the preferred embodiment, the base 30 is of a molded polypropylene having a wall thickness of 1/8 inch. Greater thickness plastic walls can be used as desired to provide a rigid base. Molded plastics are preferred. Suitable plastics include polypropylene, polyethylene, styrene, acrylonitrile, ABS and various rubber copolymers and blends known in the art. Such plastics can be blow molded, injection molded or pressure formed with or without reinforcements. In some cases the base 30 can be a solid wall or plural layered and in some cases reinforcing or other layers such as plastic foam can be positioned between the layers.

The membranes of this invention are preferably mounted by suitable frames, such as 22, as will be described. These frames can be of various sizes and have various interlocking features. In most cases, the frames are rigid and maintain the peripheral edges of the right and left foot portions against stretching allowing stretching only at the exposed areas as seen at the top of the device 19 in FIG. 3. Frames such as 22 can be formed of plastic or polymeric materials, such as polyethylene, polypropylene, ABS materials, styrenic polymers and copolymers, as well as wood, metals, mixtures thereof and the like. Similarly the base 30 can also be formed of the same or different materials as the frame 22.

The hand grips 29 are in the form of tubular rails and can be stationary or slidable, as will be described, and can be formed of plastic, wood or metal materials as known in the art. Preferably, the hand gripping portions are rigidly attached to the base 30 by suitable means such as holes 32 into which the hand grip rails 29 fit. They can be positioned merely by gravity or by fixed or releasable locking engagements of various types as known in the art, including, force fit, bayonet actions, locking pins, adhesives and the like.

In the preferred embodiment of FIG. 3, the base 30 is molded of polypropylene material having a thickness of ⅛ inch and is generally rectangular as viewed from the top, as shown in FIG. 4. The base 30 has a side to side or front length as shown in FIG. 4, of 24 inches with a front to rear depth of 18 inches and a height of 8 inches. The base 30 defines a flat top edge 50 which serves as a mounting surface to clamp a sheet elastic membrane 21 between it and a molded plastic frame member 22. The base 30 which is rectangular has four recesses or indentations 51, one on each side of the rectangular base for receiving an inwardly directed protrusion (not shown) of a flap member 52, four of which flap members 52 are provided on the frame member 22 corresponding in position to the indentations 51. Thus, it is possible to releasably snap the frame member 22 flap members 52 into each of the four recesses 51 to snap the frame in place and lock the membrane in place above the chambers 31, 31*a* in substantially fluid tight relationship, with chambers 31 and 31*a* sealed to the atmosphere. The only opening between the chambers 31 and 31*a* is the fluid passageway 24 which can be a pipe, tube or opening of any sort. Preferably, the passageway 24 has a valve 28 as described above to determine its size and resistance to flow between the chambers 31, 31*a*, and vice versa. Thus the time and pressure needed to depress either membrane portion can be varied. Chamber 31*a* and/or chamber 31 can have a passageway to the atmosphere to allow replenishment of air or other fluid in the chamber, if desired, although in normal usage, such replenishment is often unnecessary. The valve as illustrated diagrammatically by the valve member 28 can vary the size or diameter of the opening in passageway 24 to vary the resistance to flow. The chambers can be interconnected by plural passageways. One or more of such passageways can be closed or adjusted to foot and body weight. While the chambers are preferably formed by rectangular side walls and a rectangular bottom wall arrangement under each membrane foot portion, the size and shape of the chambers can vary greatly.

The substantially U-shaped rails having hand grips as shown in FIG. 3 can have a height which is substantially waist high or from mid thigh to sternum height, to support the user and improve balance when utilizing the device.

With specific reference to FIG. 3, a person is shown applying body weight to left leg 26, stretching and depressing the elastic membrane 21, which displaces fluid under the left foot, thus stretching and lifting the membrane under the right leg portion of membrane 21 and acting to aid in raising the right foot. When the weight is shifted to leg 27, the elastic membrane under the right foot is depressed and stretched which displaces fluid back into the chamber under left leg 26 assisting the membrane in returning to the position of FIG. 3 and continuing until the left foot is raised. With repetition, a smooth stepping motion is achieved. Fluid movement between the chambers is controlled by the fluid control valve 28 or other fluid control mechanism providing adjustable resistance to the stepping motion due to the speed with which the fluid can move from one chamber to the other. Resistance is increased by partially obstructing the passage 24 as the valve is moved towards a closed position. In some cases the valve can be eliminated and the size of passageway 24 predetermines a single value for resistance to flow of fluid. In some cases the valve can be adjusted prior to exercise or alternately can be adjusted during exercise. The hand grip rails 29 provided on either the left and right side of the user assists in maintaining balance and providing a small degree of support if required. It should be noted that the device can be used with the individual facing frontwards and towards the front of the device as shown in FIG. 3, or the individual can be in a turned-around position facing the rear of the device. This versatility is sometimes useful in positioning the exercise device to allow exercise while viewing different areas as may be desired. The hand rails can be provided by other means such as a tripod base or other structure not shown.

In FIG. 4, the elastic membrane 21 is shown attached to the molded snap-on frame or cover 22. The cover is supported by the molded polypropylene, fluid-containing base 30 with a divider wall 81 acting to provide both support and sealing of the cover with respect to the base to seal the chambers. Air is the preferred fluid. The air is at standard atmospheric pressure of 14.7 p.s.i. with the right and left membrane portions flat at rest when not in use. Thus body weight can be supported by a combination of the membrane strength and air pressure. The pressure of the air or other gas used can be varied as desired. Preferably the air is at ambient pressure when the device is at rest with no user supported by the membrane. The device can be adjusted to ambient pressure by opening and closing the airtight chambers by an air tight cap as at 80.

The frame or cover 22 can be mounted by snaps as shown which snaps are resilient due to the nature of the plastic material of the frame 22. Alternately, the membrane can be mounted by a variety of known mounting mechanisms. Thus the frame can be screwed to the base or attached by clamps or other means as well-known in the art. In some case the membrane can be provided with a peripheral bead as well as a bead around each left and right hand portion of the frame underlying the frame so that clamping of the frame 22 on the base aids in compressing the bead, further assuring airtight or fluid tight mounting of the membrane with respect to the chambers.

In the preferred embodiment of FIGS. 3 and 4 the chambers provide approximately 1 cubic foot of air, at standard atmospheric pressure and temperature. The chambers preferably provide from 0.5 to 2 cubic feet of sealed air although the amount can vary. Air displaced from one chamber to another under load of one foot or the other can be, for example, 0.6 cubic feet.

Figure 5:
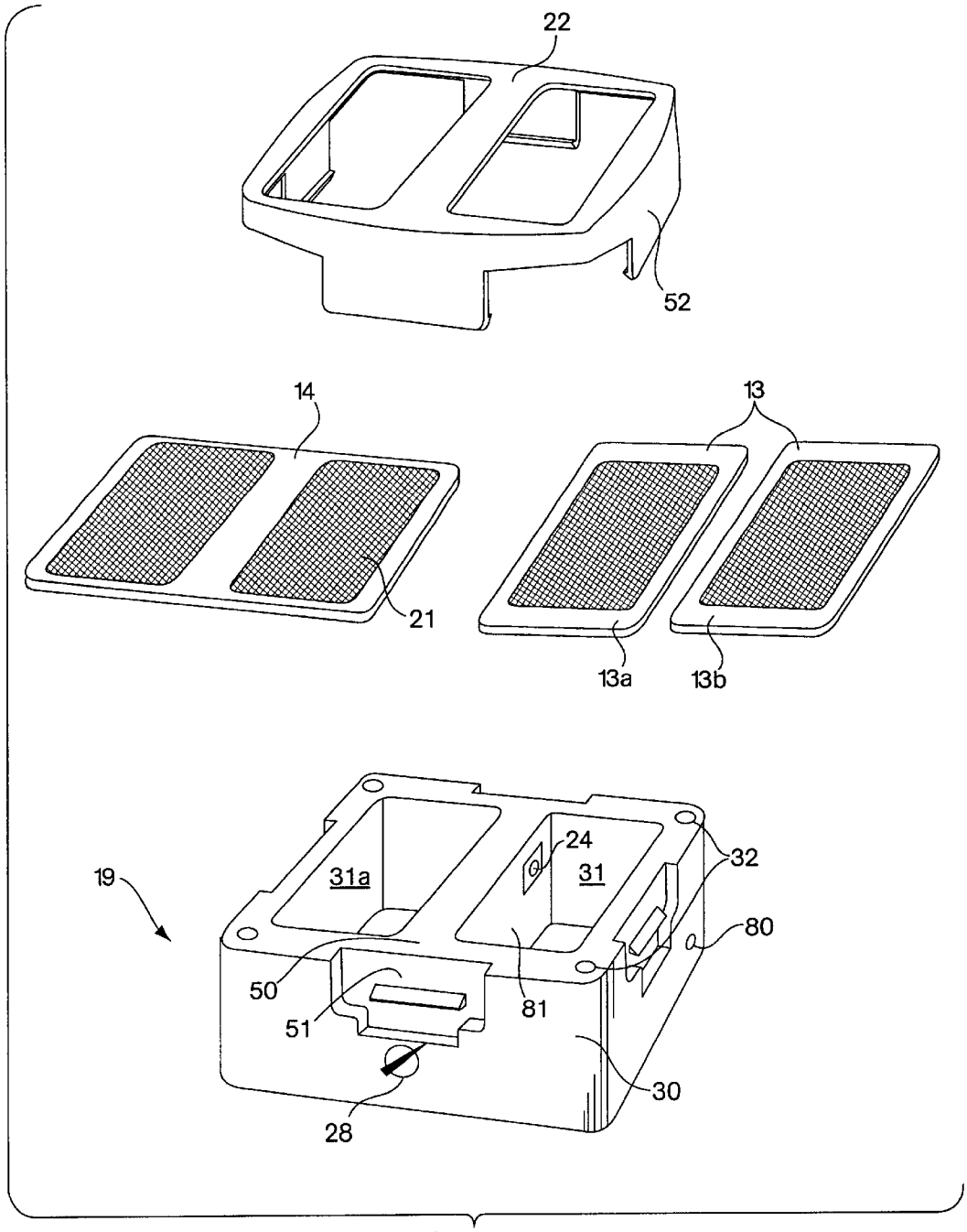
FIG. 5 is a fully exploded semi-diagrammatic front view of an embodiment of a cartridge membrane of this invention.

Turning now to FIG. 5, two membrane cartridge constructions 13 and 14 are diagrammatically shown for use with the frame or cover 22 of FIG. 3. The first membrane construction has a pair of rectangular membrane portions each identical to the other and illustrated at 13 with each membrane rectangular section enclosed and held in a rigid frame 13*a*, 13*b* which may be formed of a solid plastic, metal or wood material. The frames 13*a*, 13*b* are clamped by the peripheral frame 22 to the base 30. Frame members 13*a* and 13*b* can be used on both sides of the membrane 21 or just on one side as desired. Similarly, the frame 14 is a single frame supporting the single sheet membrane 21. The frame 14 can have a top and bottom portion as can the frames 13*a* and 13*b*. Here again, the peripheral frame or cover 22 can be used to lock the membrane in air-tight relationship to the chambers 31 and 31 *a*.

Figure 6:
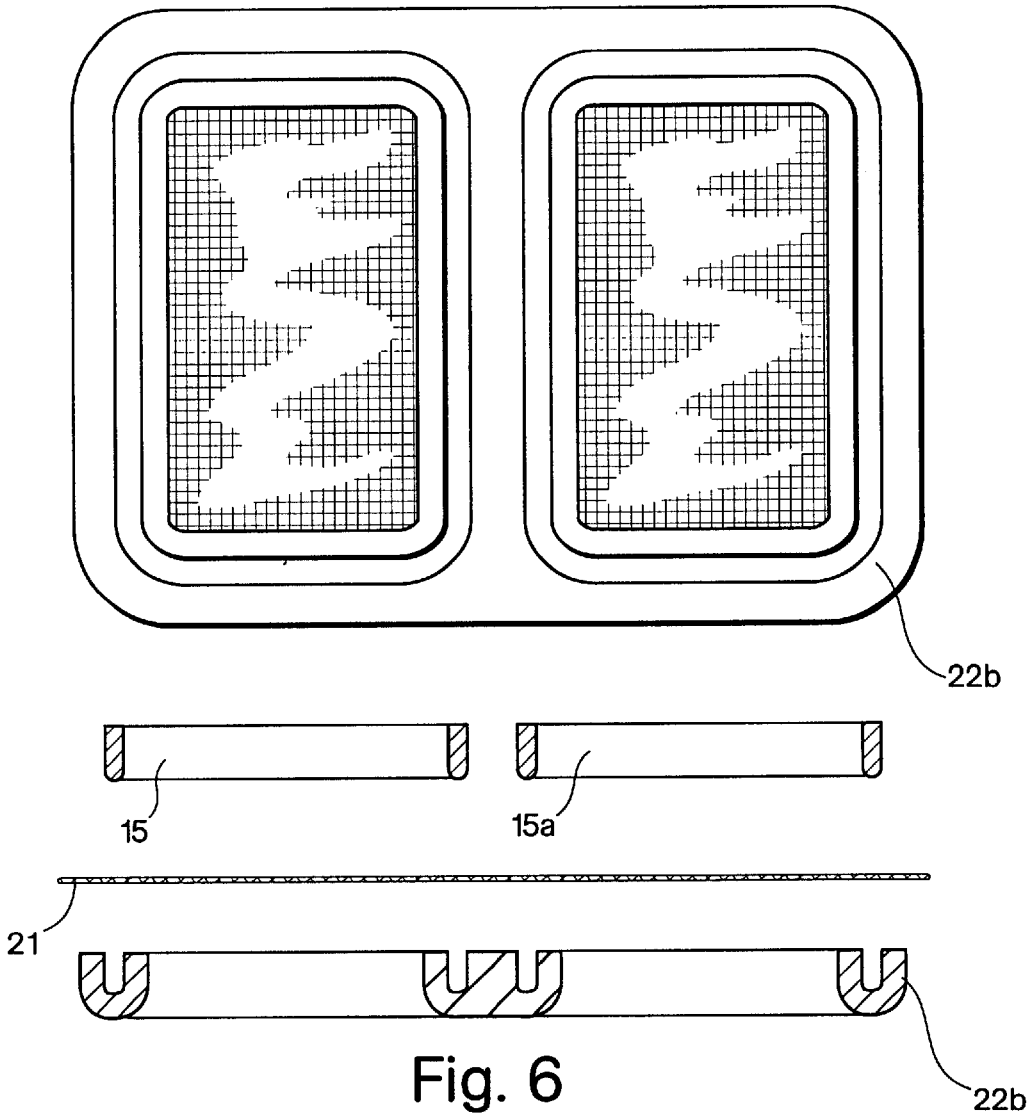
FIG. 6 is an exploded semi-diagrammatic front view of a clamping arrangement for attaching an elastic membrane to a cartridge useful in the present invention.
Figure 6A:
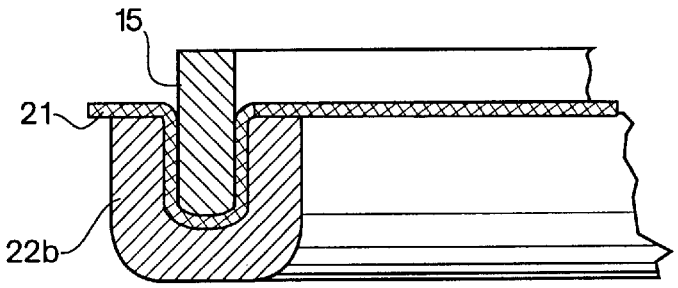
FIG. 6*a* is a cross section view of an assembled clamping arrangement of FIG. 6.

FIG. 6 and 6*a* show a diagrammatic showing of a particular locking mechanism for locking a single membrane 21 to a frame such as 22*b*. The frame 22*b* can have the outline shape of frame 14, for example. Rectangular cut-out frames or rectangular rings 15, 15*a* are sized to lock the elastic membrane 21 to the underlying frame 22*b* by a wedging action and resilient deformation of the membrane, as illustrated in the lower assembled cross-sectional view of FIG. 6*a*. Thus, locking members 15 and 15*a* lock the peripheral edges of each rectangular membrane portion to the frame 22*b* by a resilient force fit. The frame 22*b* can then be locked by a frame 22 to the base 30.

A wedge arrangement of the generally rectangular rings 15, 15*a* (which can be injected molded plastics, machined plastics, wood or of other materials), compress the elastic membrane into the mating bevel channels in the frame 22*b*. The wedge rings are shaped to the size of the corresponding channels as shown in FIG. 6 and lock the membranes in position. The connection forms a permanent cartridge which can be easily removable when replacement of the membrane is desired.

Figure 1:
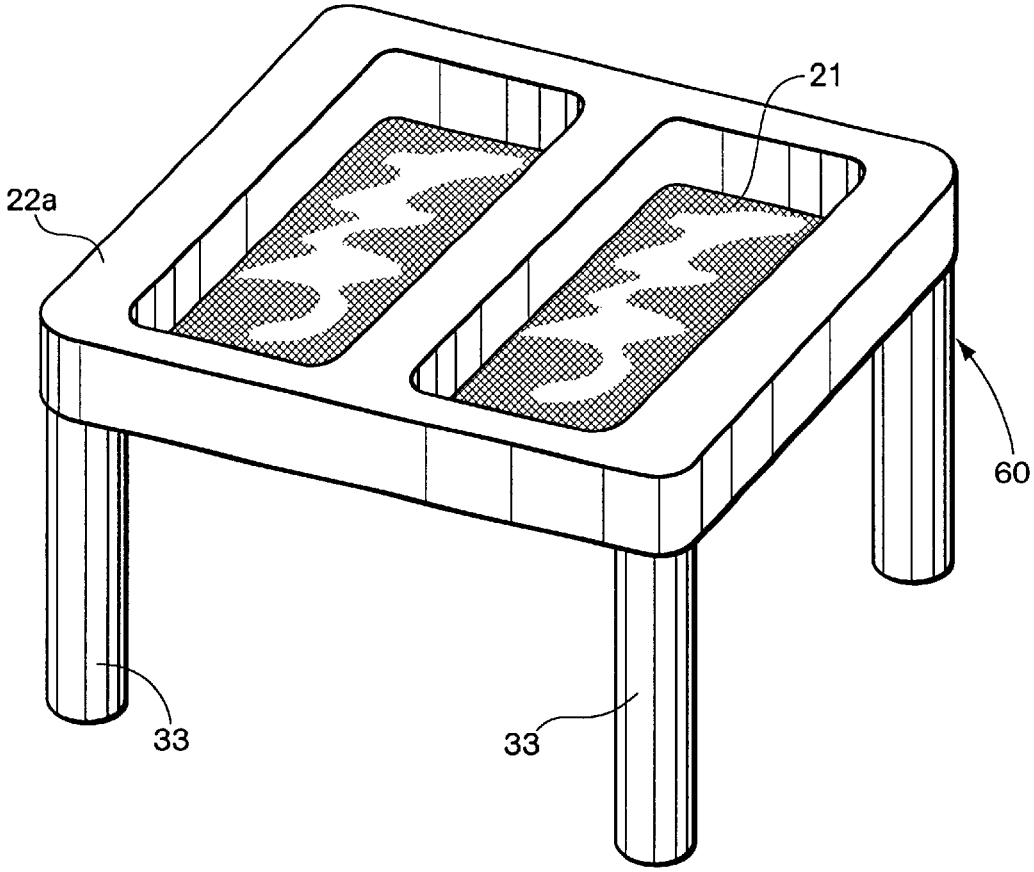
FIG. 1 is a semi-diagrammatic front perspective view of one embodiment of an exercise device of this invention, which embodiment is based on resistance of a stretchable elastic membrane.

FIG. 1 illustrates another embodiment 60 of the invention where there are no interconnected chambers below the membrane 21. In this embodiment, a top or frame 22*a* firmly mounts an elastic membrane 21 and is rigid. As in the embodiment of FIG. 3, preferably the edge of each of the right and left foot membrane portions are sealed to the frame 22*a*. The frame 22*a* may be formed of plastics, metals and the like, and rigidly locks the peripheral edge of the left and right membrane foot portions to the frame. The portions of the membrane 21, which form the left foot and right foot portions, are completely supported by the rigid frame 22*a*. Four rectangularly arranged corner posts (only three shown) 33 mounted the frame twelve inches above the ground. The exercise device 60 supports the body when the feet are positioned on the foot portions of membrane 21 and facilitates an excellent aerobic exercise for cardiovascular improvement as well as enhancing lower body strength and stamina building. Resistance is obtained from the stretching of the membrane 21. The elastic membrane in one embodiment of the FIG. 1 exercise device, is a rubber material having a thickness of 0.06 inch and a durometer of 40 Shore A. The two exposed elastic membrane foot portions of device 60 each have a rectangular outline of 10 inches by 15 inches. The membrane is elevated above the floor by the four legs 33 with sufficient height so that when a person puts all his weight on one foot, his weight will be supported primarily by the membrane without reaching the ground. Preferably, the membrane never touches the floor under the weight of the person.

Figure 2:
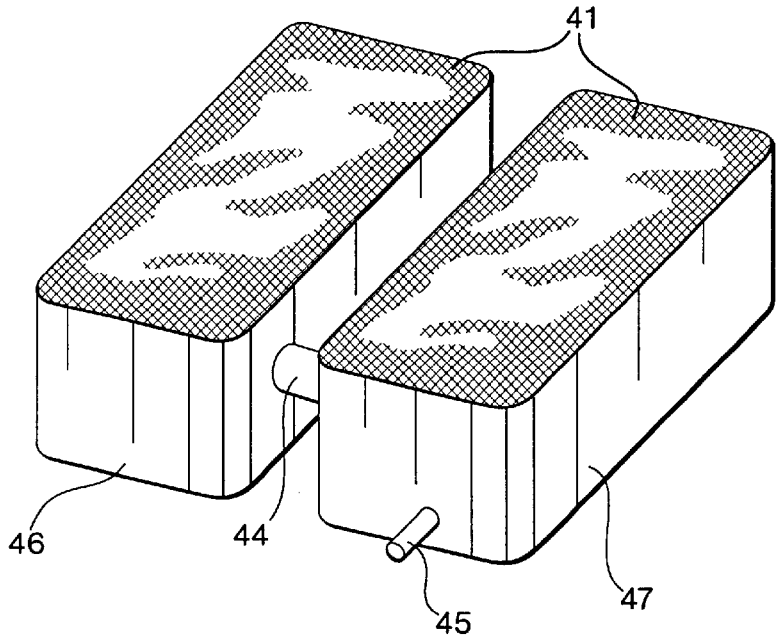
FIG. 2 is a semi-diagrammatic front perspective view of a second embodiment of invention based on the use of an elastic membrane and resistance of displaced fluid.

FIG. 2 is a diagrammatic illustration of still another embodiment of the invention. Resistance to the weight of an individual is based only on the fluid displacement between the two chambers or bladders 46, 47 each of which is a rectangular cross section chamber. The stepping surface is a flexible membrane 41 as of the same material as the membrane 21 of embodiment 19 and 60. The flexible membrane 41 can be just at the top as shown in FIG. 2, with the chambers or bladders being of an elastic material. The two chambers 46 and 47 are hollow and are connected by a tube 44. When pressure is applied to one chamber, by one foot, it partially collapses and displaces the fluid through the tube into the other chamber. Alternately, when the pressure is applied to the other chamber, it collapses to some extent and returns the fluid to the first chamber in preparation for the next cycle. The tube 44 incorporates a flow control mechanism (not shown) such as a diameter adjusting valve similar to valve 28 of embodiment 19, to provide resistance to the stepping motion of the feet. A separate tube 45 having a fluid sealing cap is provided to allow replenishment of the fluid within the enclosed system, if desired.

Figure 7:
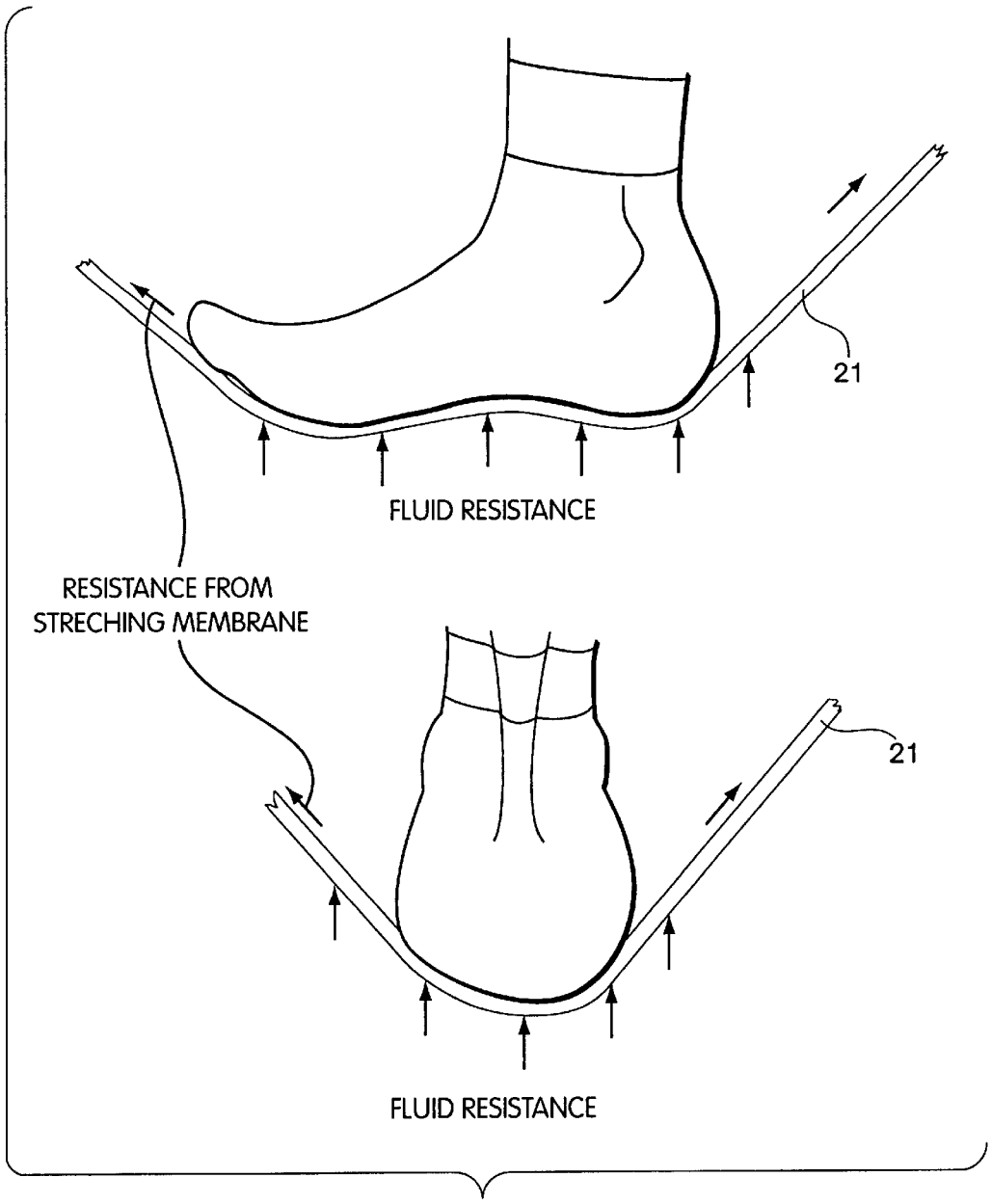
FIGS. 7 is a semi-diagrammatic combined showing of the front and side view of a user's foot cradled by and engaging an elastic membrane useful in this invention.

FIG. 7 illustrates the cradling action of the elastic membrane 21 when supporting the foot in the preferred embodiments of this invention. The gentle fluid support to the foot is provided by a combination of the tension of the stretching membrane and the pressure exerted by the contained fluid within the chamber. As shown in this figure, fluid resistance acts upwardly against all portions of the bottom of the foot and thus supports the user while providing maximized exercise effect without causing trauma to the foot of the user.

Figure 8A:
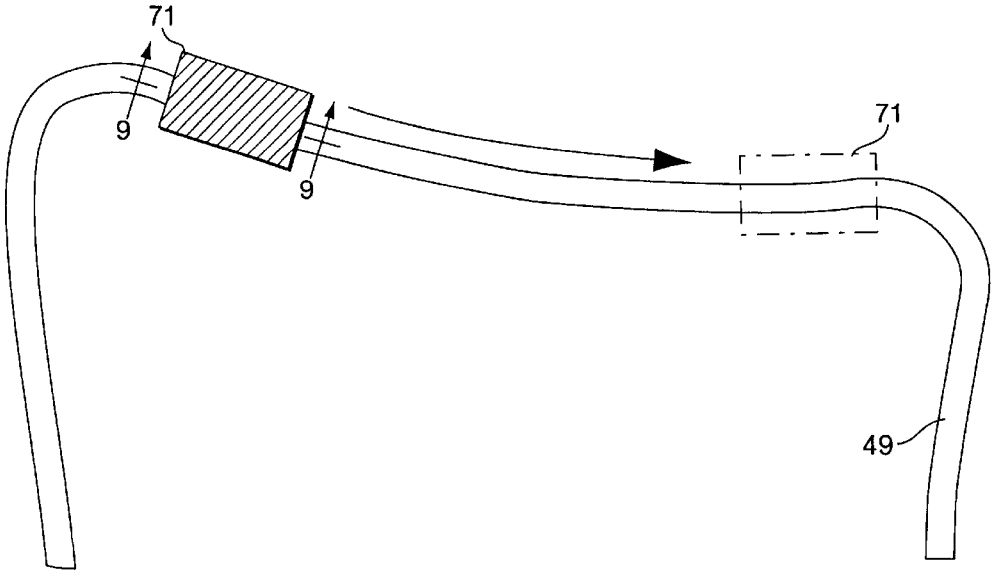
FIGS. 8 and 8a are a semi-diagrammatic views of a particular sliding hand grip embodiment of the present invention having right and left side reciprocally hand grips mounted in the base (not shown) on either side of the user's body.
Figure 8:
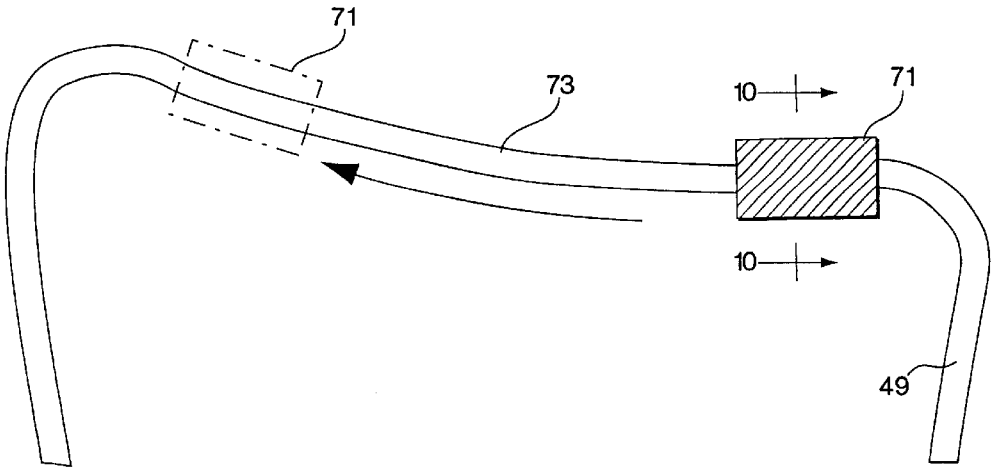
Figure 9:
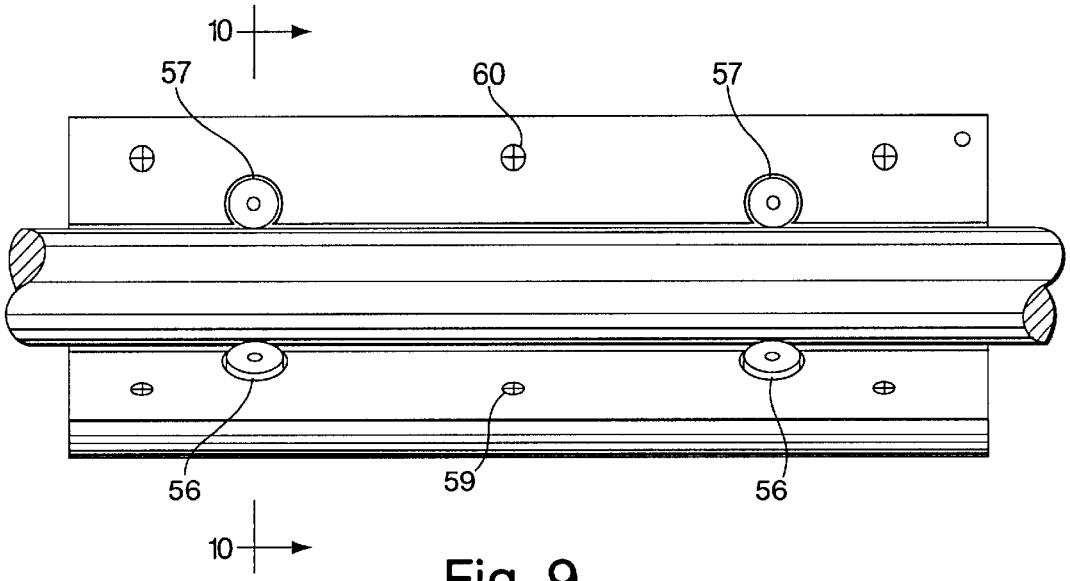
FIG. 9 is a semi-diagrammatic cross-sectional view through an axial extending center line 9—9 of FIG. 8*a;*
Figure 10:
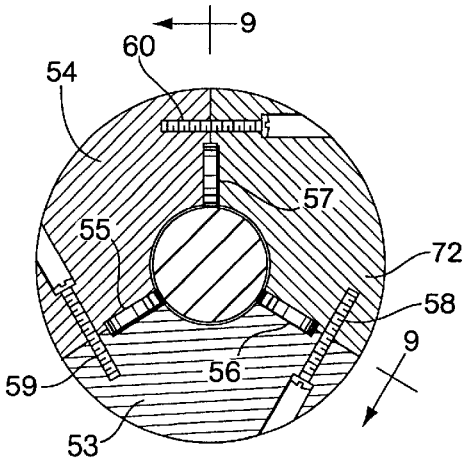
FIG. 10 is a diagrammatic cross-sectional view through line 10—10 of FIG. 8.

FIGS. 8–10 illustrate another embodiment of hand rails and hand grips of the present invention which provides for additional upper body exercise when using the device of the present invention. In the embodiment of FIGS. 8 and 8*a*, the side rails 49 are substantially similar to the hand grip, side rails 29 of the embodiment of FIG. 4. However, the rails 49 have an ergonomic curved upper portion at the top of the U, as shown at 73. In some cases, the upper portion may be horizontal, similar to the side rail 29. The rails 49, as with rail 29, may be a tubular metallic U-shaped member. For example, bent or extruded iron or aluminum piping having a diameter of 1 to ½ inches may be used. The rail can be tubular or solid shapes of various cross sections such as round, rectangular or the like.

The hand grips mounted on the rails 49 are shown at 71 and comprise plastic or metal cylindrical blocks which reciprocally slide from the outline to the cross hatched positions shown in FIG. 8 and 8*a* in use. The hands of the user slide the hand grips alternately forward and rearward as the feet are working up and down.

The sliding action can be accomplished in many different ways. A slight sliding action of the hand grips 71 on the rails can be accomplished merely by having an axially extending cylindrical hole in the hand grip mounted on the slightly smaller diameter rail portion 49. In the preferred embodiment, as best shown in FIG. 9 and 10, each hand grip comprises three generally sector-shaped sections 53, 54 and 72 extending from front to back, and defining elongated cavities mounting nylon-bearing wheels mounted therein, as diagrammatically shown at 55, 56 and 57. The nylon-bearing wheels can be ball bearings or actual wheels. These wheels bear against the underlying rail 49 and permit ease of sliding back and forth from the positions shown in FIGS. 8 and 8*a*. The hand grips can be assembled by means of locking screws such as self-tapping screws shown at 58, 59 and 60. Any sliding arrangement as known in the art can be used. While the hand grips are preferred to be mounted for sliding on the guide rails, the guide rail itself can be the hand grip and can be stationary as previously described.

Figure 11:
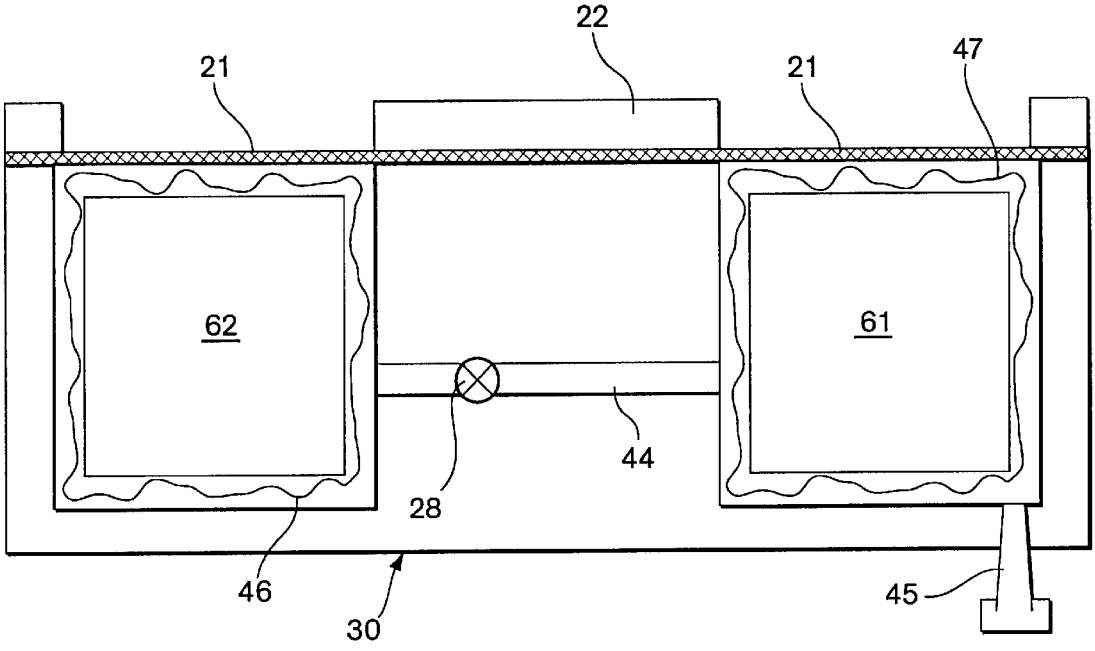
FIG. 11 is a semi-diagrammatic cross-sectional view through a lower housing of an embodiment of this invention showing a bladder underlying membrane portions of a device in accordance with the present invention.

FIG. 11 is a semi-diagrammatic showing of a cross-section through a bladder and membrane arrangement in embodiment of the present invention. As shown semi-diagrammatically, a rigid base such as 30, mounts a first and second bladder 46, 47 (as in the embodiment of FIG. 2) interconnected by a passageway or tube 44 which allows passage of fluid between chambers formed by each bladder 46 and 47. In the preferred embodiment, a membrane such as 21 overlies each bladder. The bladders underlie the membrane 21 in this embodiment and provide for easy isolation of fluid and containment of fluid in use of the device. In some cases, the bladders 46, 47 can be formed of elastic membrane material so that the membrane 21 can be eliminated. The bladders define air chambers 61, 62 interconnected by tubes 44.

In the process of using the exercise devices of this invention, the legs are moved in a stair stepping action to put the weight on one foot while fluid is shifted from that foot by such weight to push the second foot in an upward direction and support that foot until weight of the body is shifted reversing the action of the fluid flow and thus giving an exercise effect to the body. Preferably both feet are engaged by the elastic membrane in use of the exercise devices. The arms can be supported on by the hand grips if desired although the hand rails and hand grips can be eliminated in some embodiments where upper body support and balance is not required by the user. Additional exercise effect is obtained when sliding hand grips are used in conjunction with the stair stepping action of the legs.

While specific embodiments of the present invention have been shown and described, many variations are possible. The use of the single membrane to form the membrane portion below each foot is preferred, although two separate membrane portions of a non-integral membrane can be used if desired. Moreover, two or more layers of membranes can be used if desired. The membranes can be of various elastic and resilient materials. While an enclosed rigid or hard wall space or chamber can be used below each membrane to contain the fluid below each membrane, in some cases a fluid bladder such as a balloon-like device can be used below each membrane as described, for example, with respect to FIGS. 2 and 11. In all cases, the rigid compartments alone or with the bladders alone, or rigid compartments with bladder devices and preferred thickness membranes are preferably interconnected with one another through a conduit. The conduit can be adjusted in size to allow predetermined fluid flow therethrough from a membrane chamber below one foot to a membrane chamber below the other foot and vice versa. In some cases, the fluid flow can be discharged to other areas and returned from other areas rather than shifted from below one foot to the other. The conduit preferably has an adjustment valve to change the size of the orifice between the two chambers and allows for adjustment although in some cases, a single prearranged adjustment is made and no valve need be used as for example, when the diameter size of the orifice is predetermined. Preferably, each compartment or bladder is also interconnected with the atmosphere through suitable valving to supplement the fluid in the compartments if desired.

The fluid used is preferably air, although other gases can be used. In some cases liquids such as water or other liquids or gels can be used to shift between the compartments as successive alternate raising and lowering of each leg, as in a stair climbing motion, is used to shift the gas or liquid from one compartment to another. When the liquid is shifted from one compartment to another in the preferred embodiments one membrane portion will be depressed by the foot of the user while the other membrane portion may be enlarged upwardly to raise the other foot to some extent, but sometimes less than the displacement of the first foot. In some cases, a combination of conduits to the outside and more than one conduit or passageway between compartments can be used to adjust the amount of fluid flow from one compartment to the other in use and provide replenishment fluid if some fluid is leaked to the atmosphere. Adjustment of the fluid pressure as well as adjustment of fluid flow from one chamber to another, can change the exercise effect.

Preferably the user's foot contacts the membrane and thus intimacy is achieved with the foot or some non-rigid covering of the foot, which acts as a contact surface.

The positioning of the membrane portions above the ground, or any rigid surface, is such that the membrane portions at rest preferably lie in substantially the same plane, parallel to the ground or other rigid surface by a distance such that the weight of the body of the user does not allow the membrane to be lowered to reach that surface during the down motion of the foot. Successive motion in a stair-climbing type movement of the legs where the legs are alternately moved up and down, is preferably used to cause reciprocal fluid flow between two adjacent chambers.

The particular method of mounting the membrane can vary greatly, and in some cases, a balloon or other bladder-like device will act as the membrane surface portion for each foot. In other cases the bladder-like devices will be positioned under the membrane portion of this invention and in intimate contact therewith.

The exercise devices of this invention can comprise two various shaped fluid-filled chambers connected to each other to allow the passage of fluid. Thus the chamber as well as the device base shapes can vary greatly in configuration and can be for example round, square, rectangular or of other shapes. The top surface of the chambers are flexible and adequate in size to accommodate a person's right foot on one chamber and the left foot on the other chamber. As a person applies weight to the left foot on the left chamber, the fluid is forced from the left chamber into the right one, lifting the right stepping surface as the right foot is being lifted. Shifting the weight to the right foot causes the fluid to be forced back to the left chamber thereby lifting the left surface.

It is a feature of this invention that a vigorous aerobic workout can be obtained with zero hard impact. Fluid support reduces compression and strain on the joints and soft tissues. There is a reduced risk of injury to the body and reduced strain on joints and tissues when exercising even with an existing injury. Exercise takes place preferably without wearing shoes with zero impact force on foot parts while the flexible membrane supported by the fluid chamber allow a wide range of motion. Micro adjustment of the muscles of the foot supported by the fluid develops the ability to balance the body while controlled fluid flow provides.

What is claimed is:

1. An exercise device for supporting a left and right foot of a user and allowing alternate successive raising and lowering action of each foot for exercise of said user, said device comprising:

a first elastic membrane portion and a second elastic membrane portion in position to closely support said left and right foot of a user above the ground, a support structure for said first and second membrane portions for permitting raising and lowering movement of said left and right foot in a stair stepping action to elastically stretch said membrane portions in succession and allow return to said unstretched condition, said support structure comprising a base defining a first and second fluid containing chamber, each chamber having substantially rigid surfaces and an open top, a fluid underlying said first and second elastic membrane portions which fluid is displaced by stretching of each membrane portion and at least one passageway interconnected with said base for determining fluid flow under said first and second elastic membrane portions.

2. An exercise device in accordance with claim 1, wherein said fluid is contained in chambers under said first and second elastic membrane portions and shifted from beneath one portion to the other and vice versa in successive raising and lowering of each foot of a user in a stair stepping action.

3. An exercise device in accordance with claim 2, and further comprising left and right hand grips for balancing the body.

4. An exercise device in accordance with claim 1 wherein said fluid is contained in first and second yieldable chambers underlying said first and second elastic membranes.

* * * * *